United States Patent [19]

Morris

[11] 4,157,122

[45] Jun. 5, 1979

[54] ROTARY EARTH BORING DRILL AND METHOD OF ASSEMBLY THEREOF

[76] Inventor: William A. Morris, 1110 Central, Houston, Tex. 77012

[21] Appl. No.: 808,905

[22] Filed: Jun. 22, 1977

[51] Int. Cl.[2] ..... E21B 9/10

[52] U.S. Cl. ..... 175/369; 29/447; 76/108 A; 175/371

[58] Field of Search ..... 175/372, 375, 371, 369, 175/370; 76/108 A; 308/8.2; 29/447

[56] References Cited

U.S. PATENT DOCUMENTS

| | | | |
|---|---|---|---|
| 1,865,808 | 7/1932 | Abegg | 29/447 X |
| 2,620,686 | 12/1952 | Peter | 175/369 |
| 2,787,481 | 4/1957 | Buschow et al. | 29/447 X |
| 2,807,444 | 9/1957 | Reifschneider | 175/375 X |
| 3,361,494 | 1/1968 | Galle | 175/371 |
| 3,656,764 | 4/1972 | Robinson | 175/371 X |
| 3,866,987 | 2/1975 | Garner | 175/371 |
| 4,043,411 | 8/1977 | Lichte | 175/375 X |

*Primary Examiner*—William Pate, III
*Attorney, Agent, or Firm*—James L. Jackson

[57] ABSTRACT

Rotary earth boring bits according to the present invention and method of assembly thereof allow development of a rotary earth boring bit construction of low cost nature and having exceptionally good wear life. The drill construction promotes the use of optimum bearing materials for rotary support of the cutters of the drill thereby promoting exceptionally good service life. Additionally, the bearing of each cutter assembly may be lubricated so as to further enhance the service life of the drill. Assembly may be accomplished at low cost by taking advantage of dimensional changes of the parts responsive to heating or cooling. The drill cutter may be heated to increase the dimension of the bearing cavity formed therein while the bearing and its support spindle may be cooled to reduce the external dimension of the bearing. Following assembly of the bearing and spindle to the cutter a tight retention fit will develop between the bearing and cutter as these parts approach normal temperature. To further insure retention of the cutter in assembly with the bearing, a retainer element may be located during assembly within registering retainer grooves formed in the cutter and bearing.

24 Claims, 10 Drawing Figures

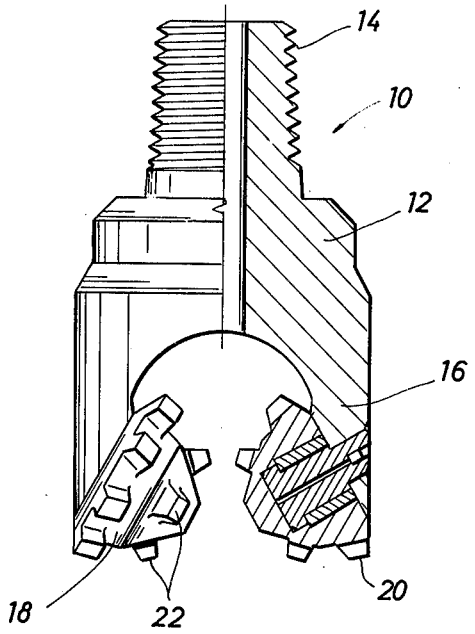
FIG. 1
FIG. 2
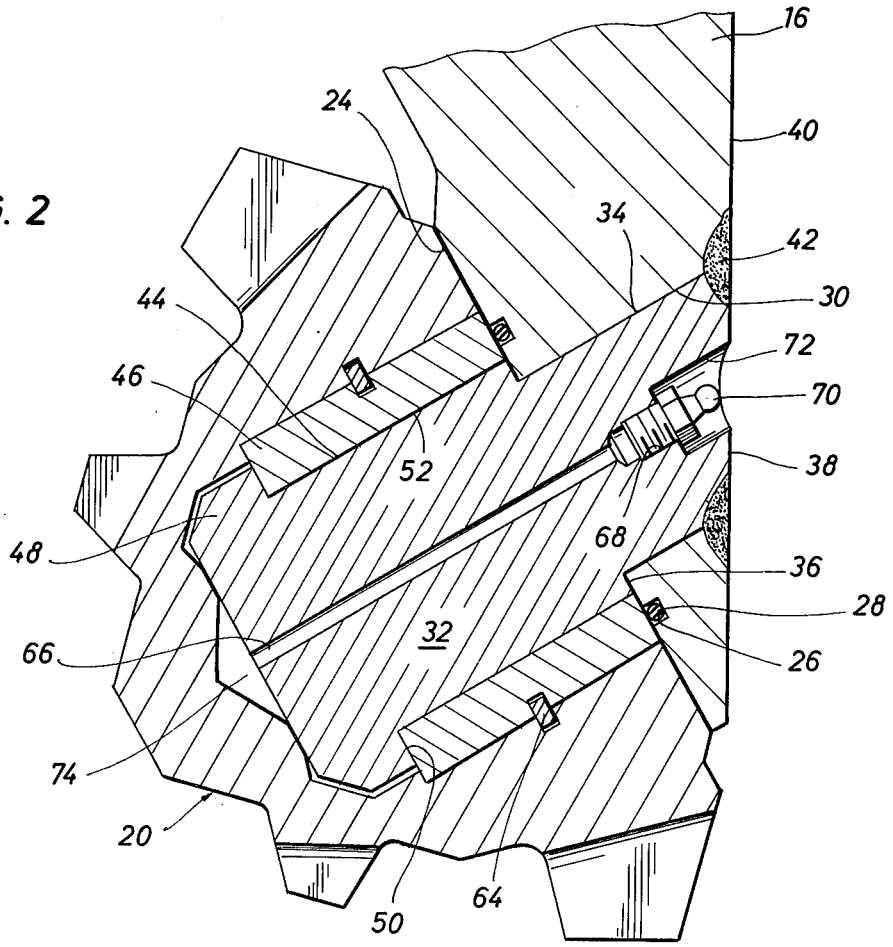

ROTARY EARTH BORING DRILL AND METHOD OF ASSEMBLY THEREOF

FIELD OF THE INVENTION

This invention relates generally to earth boring apparatus and more particularly to earth boring drills having rotary cutters for the purpose of accomplishing boring operations in relatively hard, consolidated earth formations. This invention also relates to a method of assembling earth boring drills constructed in accordance with the invention.

BACKGROUND OF THE INVENTION

In the drilling of deep wells in earth formations many different types of earth formations are encountered and boring or drilling operations in each of these types of formations require differing boring equipment. For example, in loose or unconsolidated earth formations such as gravel strata, it is desirable to utilize integral drill bits having a plurality of blades for cutting away the formation. Where consolidated, very hard earth strata is encountered, for example, in deep earth formations, it is typically desirable to employ drill bits having a plurality of rotary toothed cutters. The teeth of the rotary cutters are cooperatively associated so that the earth formation is cut away as the drill bit is rotated at the extremity of the drill pipe extending from the drilling rig to the formation being drilled. The typical rotary cutter type drill bit or "rock bit" includes a body portion from which depend three legs. Spindles or cutter supports extend inwardly toward the center line of the drill bit from each of these legs. Rotary cone type cutter elements having cutter teeth formed thereon are typically rotatably secured to each of the supports or spindles and are oriented in such manner that the cutter teeth thereon engage and cut away the earth formation as the bit structure is rotated by the drill pipe.

One of the paramount disadvantages of drill bits having rotary cutters is the inability of the cutter bearings to withstand the severe wear characteristics to which the drill bit is typically subjected. As drilling operations occur, rock bits are subjected to severe impacting and vibration as well as other wear inducing factors that are highly detrimental to the service life of the rotary cutter bearings and other components of such drill bits. At times, much of the weight of the drill pipe to which the rotary drill is connected may be caused to act upon the cutter, subjecting the cutters and their bearings to tremendous mechanical loads. It is therefore desirable that rotary drill devices be provided which incorporate bearings having the capability of withstanding extremely high forces, excessive vibration as well as high temperature operation.

Typically, the drill bodies of rotary cutter devices take the form of integral cast or forged structures that are very expensive to manufacture because of the complex configuration thereof. It is also desirable to provide a rotary drill bit construction having a body structure of exceptional strength and durability and yet being of relatively low cost. Drill bit cost is also adversely affected by the typical requirement for expensive materials for most of the structural components of such bits. For example, an expensive bearing quality material may be required for the drill cutters or the entire body structure of the bit if any part thereof is to define a wear resistant bearing surface.

It is therefore a primary feature of the present invention to provide a novel rotary cutter type drill bit construction that allows optimum utilization of materials for the various components thereof to insure optimum drilling capability and exceptional service life.

It is also a feature of the present invention to provide a novel rotary cutter type earth boring drill construction wherein a unique cutter supporting bearing and spindle assembly may be connected to structural components of the drill body by welding.

Among the several features of the present invention is contemplated the provision of a novel rotary earth boring drill construction incorporating bearing and spindle assemblies that, through optimum use of material, are capable of withstanding extremely severe operational loads.

It is an even further feature of the present invention to provide a novel rotary earth boring bit construction whereby the body structure of the bit may be formed by assembling a plurality of low cost body sections, thereby promoting the low cost aspects of the drill construction.

It is also an important feature of the present invention to provide a novel rotary earth boring bit construction whereby rotary cutter elements are assembled to respective spindle and bearing assemblies utilizing controlled changes in dimension by heating and cooling various ones of the drill bit components.

It is also a feature of the present invention to provide a novel rotary earth boring drill construction whereby mechanical locking means may be provided to insure positive locking of rotary cutter elements to the spindle bearings and thereby insure against separation of the cutter elements by vibration and other operationally induced forces.

It is a feature of the present invention to provide a method of manufacturing a rotary cutter type drill bit wherein cutter, bearing and spindle assemblies may be developed prior to attachment thereof to the drill body.

It is an even further feature of the present invention to provide a method of manufacturing a rotary cutter type drill bit wherein cutter, bearing and spindle assemblies may be assembled to body sections prior to connection of the body sections to form an integral body.

Other and further objects, advantages and features of the invention will become obvious to one skilled in the art upon an understanding of the illustrative embodiments about to be described and various advantages, not referred to herein, will occur to one skilled in the art upon employment of the invention in practice.

THE PRIOR ART

Rotary-cutter type roller drills have been commercially available for an extended period of time as indicated by Godbold in U.S. Pat. No. 1,325,086. In some cases, the structure of the drill bit body has also been employed to accomplish bearing capability as taught by U.S. Pat. Nos. 2,620,686 of Peter and 3,361,494 of Galle. Various types of bearings have also been employed to support roller cutters such as the complex structures illustrated in U.S. Pat. Nos. 1,839,589, 2,004,012 and 2,126,041 all of Reed. Reed U.S. Pat. Nos. 1,839,589 and 2,004,012 and 1,957,532 of Flynn each disclose earth boring drill constructions employing spindle structures that are secured to the body structure of the bit by mechanical means such as welding, bolting or the like.

SUMMARY OF THE INVENTION

Rotary earth boring drill bit structures having rotary cutter elements are provided in accordance with the present invention having cutter elements that are uniquely connectable to the body structure of the bit and which function efficiently to withstand the detrimental effects of excessive loads and vibration during drilling operations. Depending leg structures of the drill body may be formed to define spindle bores that receive a bearing spindle which may be secured to the depending leg structures by a simple welding operation. The spindle structure may be composed of metal having unique bearing capability and a cylindrical bearing surface may be formed on the spindle in conventional manner. The bearing surface may be specifically treated such as by chrome plating, if desired to provide additional resistance to wear under exceptionally heavy loads. Prior to assembly of the spindle structure to the drill body by welding or any other suitable form of connection, a bearing element will be assembled to the spindle and the spindle and bearing assembly will be assembled to a rotary cutter.

The rotary cutter will be of generally cone like configuration having a plurality of external teeth formed thereon for cutting engagement with the earth formation to be drilled. Each of the cutter elements is also formed to define an internal cavity of particular size and configuration for receiving the bearing and spindle assembly. The cavity is defined in part by a tapered internal surface that cooperates with a tapered external surface defined by a sleeve bearing that causes a mechanically interlocked relationship to develop between the cutter element and the bearing. The particular taper of the internally tapered surface of the cutter and externally tapered surface of the bearing is correlated with the coefficient of expansion of the particular materials from which the cutter and bearing are composed. The method of assembling the cutter to the spindle and bearing assembly comprises heating the cutter element to a particular temperature, for example 225° C. and at the same time cooling the bearing and spindle assembly to a low temperature, for example −75° C. or −175° C. After this has been done, the cooled cutter and spindle assembly is inserted into the cavity of the cutter, bringing the tapered surfaces of the cutter and bearing into intimate engagement. After the heated and cooled parts reach normal temperature, for example 25° C., external expansion of the bearing element and internal contraction of the internally tapered surface of the cutter will develop a tightly seized relationship between the bearing and cutter. Thus, the cutter, which may be composed of metal having exceptional abrasion resistance, may be provided with a bearing composed of material having exceptional bearing capability. To further enhance the wear resisting characteristics of the rotary cutter, spindle and bearing assembly the spindle may be provided with a lubrication system, enabling the bearings of each of the cutters to be lubricated as desired.

A simple and low cost drill body structure may be developed in accordance with the present invention by providing a plurality of body segments that may be assembled in any suitable manner. Each of these body segments may be composed of low cost forgings or castings of a material having sufficient strength for adequately resisting the forces to which the body structure will be subjected during drilling operations and yet being of relatively low material cost. The simple structure of each of the body segments enables the body segments to be developed by forging or casting at relatively low cost. Additionally, each of the body segments may be of generally identical configuration, thereby simplifying the pattern or mold costs that are required for production of the body structure. For example, the body structure may be composed of three segments that may be placed in intimate assembly. The segments may be joined by welding to form an integral drill body structure.

BRIEF DESCRIPTION OF THE DRAWINGS

In order that the manner in which the above recited advantages and features of the invention are attained as well as others, which will become apparent, can be understood in detail, more particular description of the invention, briefly summarized above, may be had by reference to the specific embodiments thereof that are illustrated in the appended drawings, which drawings form a part of this specification. It is to be understood however that the appended drawings illustrate only typical embodiments of the invention and are therefore not to be considered limiting of its scope, for the invention may admit to other equally effective embodiments.

In the drawings:

FIG. 1 is a pictorial representation of a rotary cutter type drill bit constructed in accordance with the present invention.

FIG. 2 is a fragmentary sectional view of the drill bit structure of FIG. 1 illustrating one of the leg structures of the drill body and showing the assembled relationship between the leg, a rotary cutter element and a bearing and spindle assembly.

DETAILED DESCRIPTION OF PREFERRED EMBODIMENTS

Figure 3:
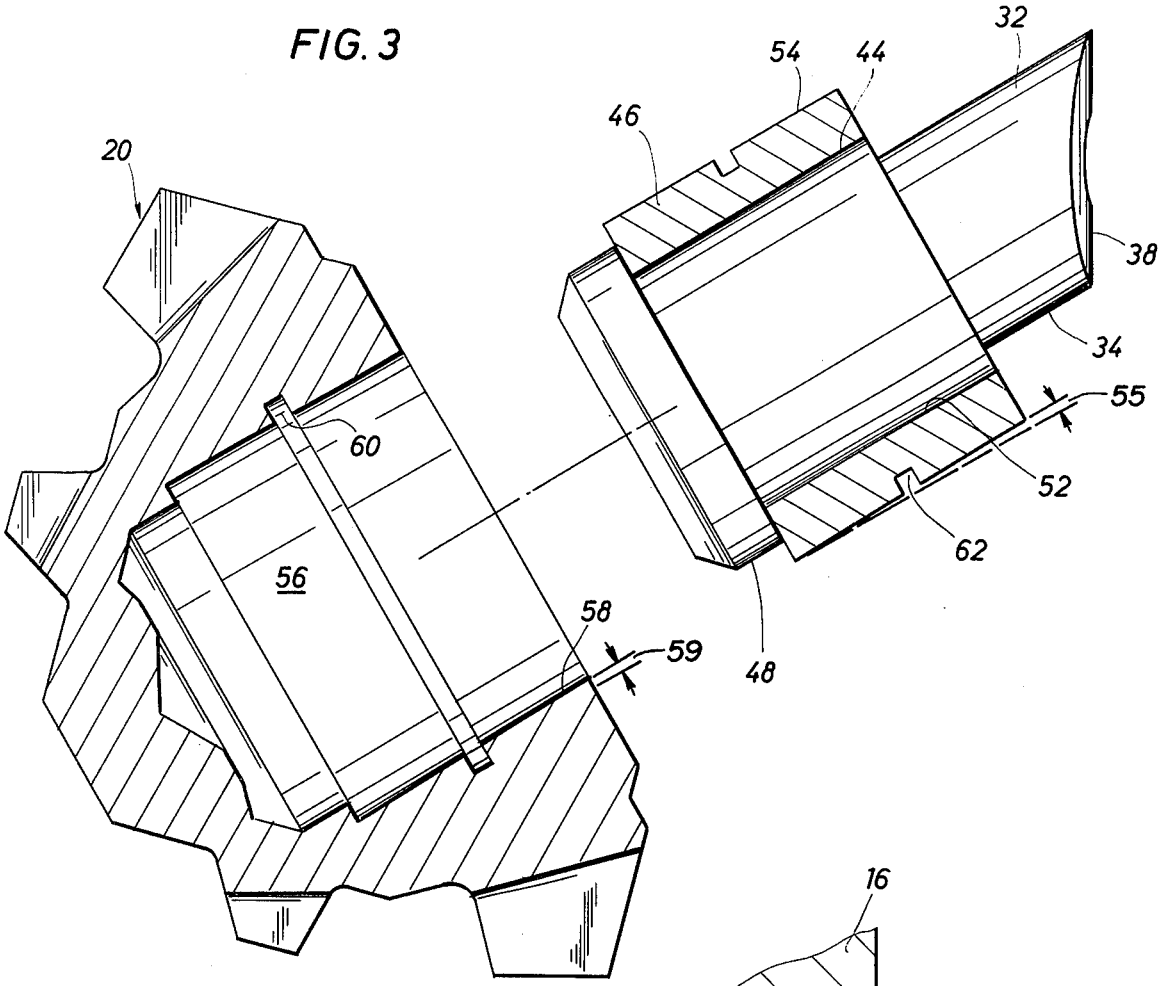
FIG. 3 is an exploded view of a drill cutter and a bearing and spindle assembly with part thereof being shown in section.

With reference now to the drawings and first to FIG. 1, a rotary cutter type drill bit shown generally at 10 in quarter section which is also typically referred to in the industry as a "rock bit". The rotary bit structure 10 generally comprises a body structure 12 having a threaded upper extremity 14 for attachment of the drill bit to the lower section of a string of drill pipe, not shown. The body structure 12 also includes a plurality of depending cutter support legs 16 each supporting a rotary cutting element such as shown at 18 and 20 each having a plurality of teeth 22 formed thereon to provide for optimum engagement between the teeth of each of the cutter elements and the formation being drilled. Each of the cutter elements of the bit structure will be of slightly different configuration, whereby the teeth of each cutter will cooperate with the teeth of the other cutters to provide for efficient cutter engagement with the formation as the rock bit is rotated relative thereto.

Referring now to FIG. 2, the rotary cutter 20 and its support structure is illustrated in greater detail. The depending leg 16 of the drill bit body structure may be formed to define a generally planar bearing face 24 against which the cutter element 20 bears as it rotates relative to the body structure of the bit. An annular groove 26 may also be defined in the bearing face portion of each depending leg 16 and a suitable sealing element, such as an O-ring 28, for example, may be located within the annular groove 26 to prevent ingress of drilling mud into the support bearing of the cutter and cutter support assembly. The depending leg structure 16 may also be formed to define a bore 30 having its axis oriented in such manner as to intersect the center-line axis of the drill bit. If the drill bit incorporates rotary cutter elements for example, the center-line axis of each of the bores 30 will be oriented to intersect the vertical center line of the drill body at a point, unless it is desirable to orient the rotary axis of each of the rotary cutters in some other desirable manner.

A cutter support spindle 32 may be provided which includes a reduced diameter portion 34 adapted to be received within the bore 30. The reduced diameter portion 34 of the spindle may be inserted into the bore 30 to such extent that an annular shoulder 36 of the spindle engages the bearing face surface 24, thus controlling the position of the spindle relative to the depending leg structure 16 of the drill body. The spindle may also be formed to define an inclined end surface 38 that may be oriented in surface alignment with the outer surface 40 of the depending leg 16. Connection between the spindle and the depending leg 16 may be positively established by welding as shown at 42.

Prior to assembly of the spindle structure 32 to the depending legs 16 of the body structure of the bit, it will be desirable to form an assembly between the rotary cutter elements 20 and the respective bearings and spindles thereof. This may be conviently accomplished in the manner identified particularly in conjunction with FIGS. 2 and 3. To establish a rotatable relationship between the rotary cutter element 20 and the spindle 32, the spindle may be formed to define a cylindrical bearing surface 44 about which may be received a bearing element 46. The bearing surface 44 may be such as to provide for efficient smooth rotation of the bearing 46 relative to the spindle. For example, the bearing surface 44 may be chrome plated if desired and may be ground to an extremely smooth finish. If the metal from which the spindle 32 is formed is of extremely good bearing quality, the bearing surface 44 may simply be surface ground to an efficient finish for good bearing capability. The spindle structure may also be formed to define an enlarged head portion 48 defining an annular shoulder 50 that cooperates with the bearing 46 to retain the bearing in proper operative position relative to the bearing surface 44.

It is desirable that each of the rotary cutter elements of the drill bit have a positively retained and nonrotatable relationship with the exterior surface of the bearing element 46. This feature may be conveniently accomplished in the manner illustrated in the exploded view of FIG. 3. As shown at the lower portion of FIG. 3, the bearing element 46 is shown to be provided with a generally cylindrical internal bearing surface 52 that is positioned in intimate bearing engagement with cylindrical surface 44 of spindle 32 upon assembly. The bearing 46 is also formed to define an external cutter engaging surface 54 that is tapered as shown at 55 with respect to the cylindrical surface 52 such that the bearing structure 46 is provided with a large extremity directed toward the cutter element and a small extremity directed toward the planar surface 24 of depending leg 16. The taper of surface 54 may, for example, be in the order of 0.002 inches throughout the length of the bearing element 46, which may be in the order of 2 inches. Conversely, the cutter element 20 may be formed to define an internal cavity 56 which is of a configuration to receive the head portion 48 of the spindle and the bearing 46 in close relationship therein. The cavity 56 may be defined in part by a tapered surface 58 that is of larger dimension at the inner extremity thereof than at the outer extremity as shown at 59. Throughout the extremity of the tapered surface 58 the degree of taper may be in the order of 0.002 inches for example. The internal dimension of the cavity 56 defined particularly by tapered surface 58 may be correlated with the dimension of the external surface 54 of the bearing such that an extremely tight fit will be developed between surfaces 54 and 58 when the cutter and bearing are in assembly. Moreover, the enlarged inner extremity of the bearing 46 and the cavity 56 will allow the cutter element to be firmly mechanically interlocked with the bearing element 46, thereby preventing not only rotation between the cutter and the bearing but also preventing separation of the cutter from the bearing.

To accomplish assembly of the cutter elements to the respective bearing and spindle assemblies, the cutter elements may be heated for the purpose of increasing the internal dimension established by the tapered surface 58, while at the same time the bearing and spindle assembly may be cooled for the purpose of reducing the external dimension of the bearing. For example, a rotary cutter element having a cavity dimension of 1.504 inches at a normal temperature of 25° C. (72° F.) when heated to a temperature of 225° C. was determined to have increased in internal dimension to 1.5076 inches. At the same time, reducing the temperature of the bearing and spindle assembly from a normal temperature of 25° C. (72° F.) to −75° C. (−100° F.) resulted in a dimensional decrease of the external surface of the bearing from 1.503 inches to 1.5022 inches. With the drill cutter thus heated and the bearing and spindle assembly cooled, it is possible to readily force the bearing into properly seated relationship within the cavity 56 of the cutter. It should be borne in mind that the heated, cooled and normal temperature relationships set forth hereinabove, together with the particular dimensions identified at these temperatures, is not intended to be in any way limiting as far as this invention is concerned. It is considered obvious that other temperature ranges and dimensions may be utilized for the various parts, depending upon the particular coefficient of expansion of the materials involved, without departing from the spirit or scope of this invention.

In the event the drill bit might be subjected to extremely heavy loads or excessive vibration, it may be desirable to provide means other than the mechanical expansion and contraction of parts to retain the cutters in assembly with the bearing structures. If this is desired, the cutters may be formed to define an internal groove 60 that may be positioned in registry with an annular groove 62 formed in the outer periphery of the bearing 46 when the bearing is properly positioned within the cavity 56. In this case, a retainer ring 64 shown in FIG. 2 may be located within the groove 62 of the bearing prior to assembly of the bearing and cutter. The retainer ring 64 may be a split ring capable of bearing substantially fully received within the annular groove 62 of the bearing, thereby enabling the retainer ring to be forced into the cavity 56 of the cutter along with the bearing during assembly. As the annular groove 62 of the bearing moves into registry with the groove 60 of the cutter, the retainer ring, which may be formed of spring material, will expand so as to become partially received within both of the grooves 60 and 62. After the retainer ring has become so positioned, the cutter element will separate from the bearing 46 only upon the development of forces that are sufficiently great to shear the retainer ring 64.

It may also be desirable to provide the drill cutter assembly with means for providing periodic lubrication of the cutter bearing. This may be conveniently accomplished by forming the spindle structure 32 shown in FIG. 2 with a lubricant passage 66, the outer extremity of which may be internally threaded as shown at 68. At externally threaded lubricant fitting such as a conventional Zerk fitting 70 may be extended through a recess 72 and may be received within the internally threaded portion 68 of the lubricant passage. The recess 72 allows the fitting 70 to be recessed sufficiently to prevent the fitting from being damaged or worn as drilling operations are conducted. The space between the spindle and bearing assembly and the internal wall surfaces of the cavity 56 effectively define a reservoir 74 that receives a quantity of lubricant. As drilling operations occur, lubricant will be transferred to the bearing surfaces 44 and 52.

Figure 4:
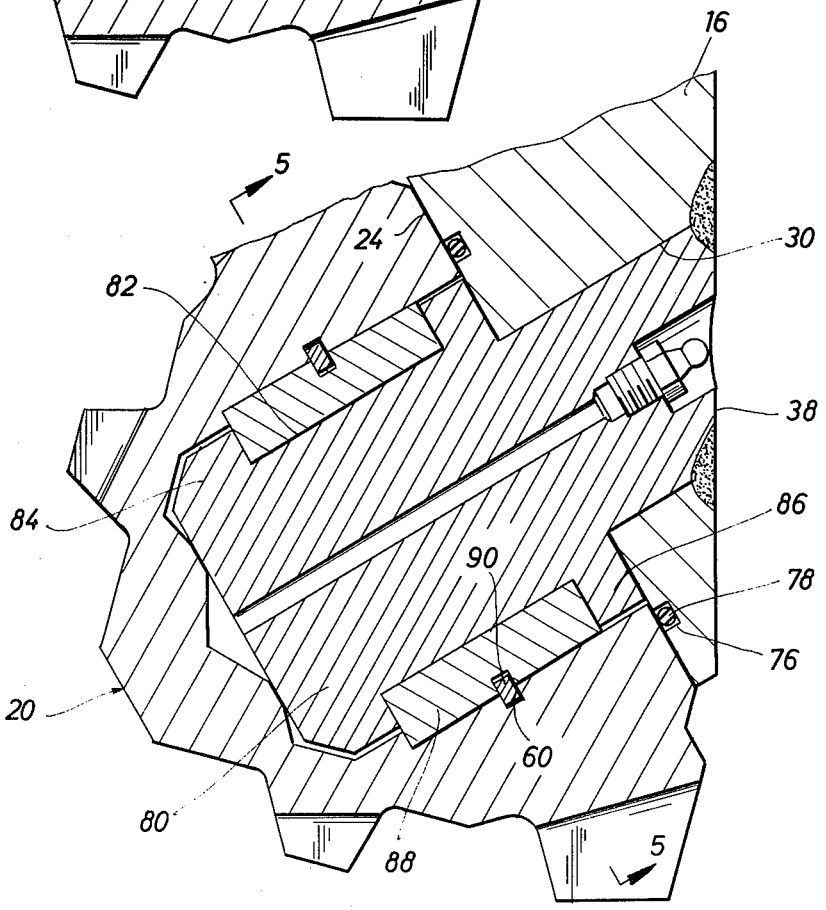
FIG. 4 is a fragmentary sectional view of a drill bit structure representing a modified embodiment of the present invention.
Figure 5:
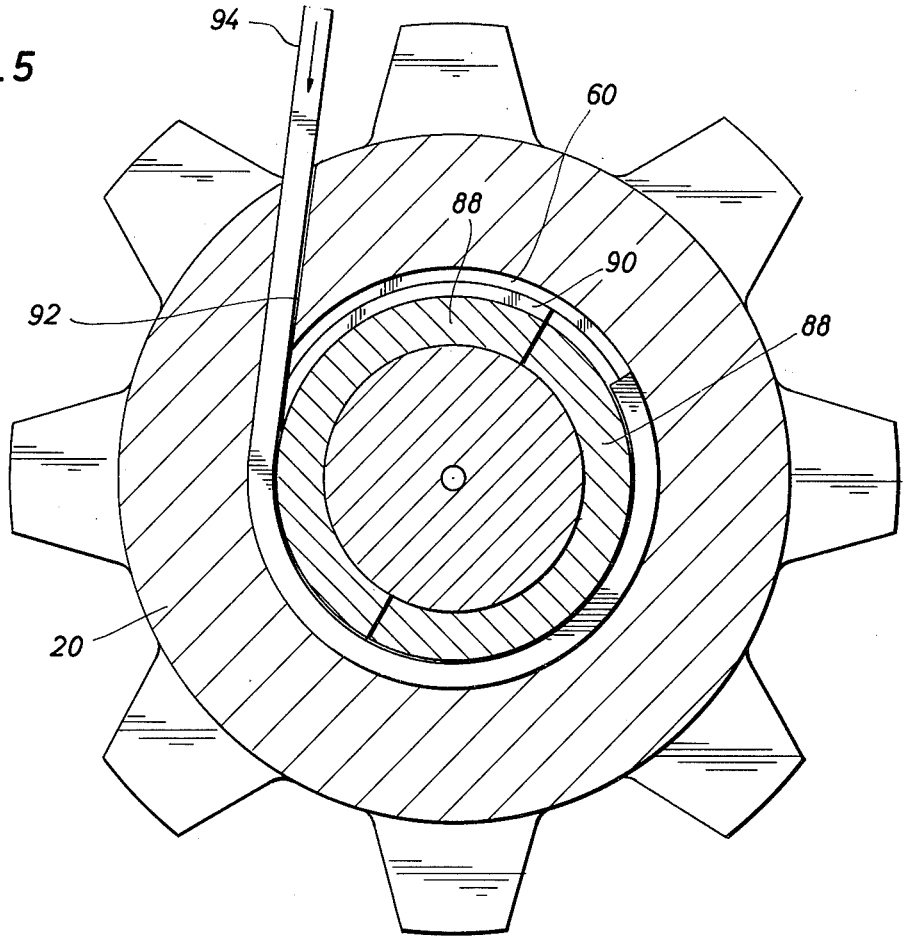
FIG. 5 is a sectional view taken along line 5—5 of FIG. 4.
Figure 9:
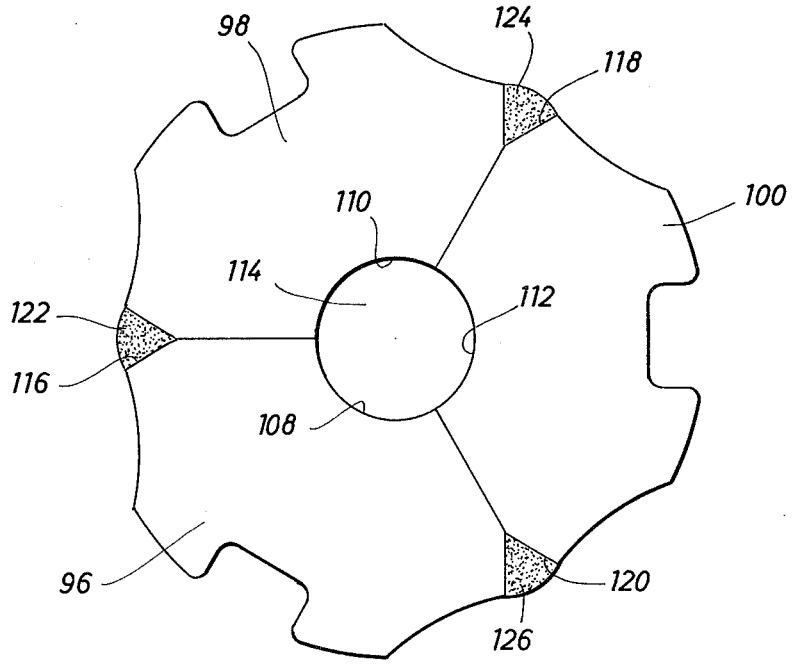
FIG.9 is a transverse sectional view of a drill body structure formed by three connected body sections and showing the body sections to be welded together to form an integral drill body structure.

FIGS. 4 and 5 are representative of a further embodiment of the present invention, whereby the depending leg structure of the drill body may take similar form as illustrated in FIGS. 1 and 2, with the exception that an annular seal groove 76 may be provided for containing a sealing element 78 such as an O-ring. The annular groove 76 will be of larger dimension as compared to the annular groove 26 in FIG. 2. A spindle element 80 may be provided that is retained in connection with the depending leg structure 16 in the same manner as discussed above in connection with FIG. 2. The spindle 80 may be formed to define a bearing surface 82 of cylindrical configuration, which bearing surface may be located between an enlarged head portion 84 and an intermediate flange portion 86. In this case, a bearing structure may be provided in the form of a pair of semicylindrical bearing segments 88 each having an exterior locking groove 90 formed therein. The cutter element 20 will be of substantially identical configuration as compared to the cutter shown in FIG. 2 with an annular internal groove 60 formed therein for registry with the grooves 90 of the bearings segments 88. As shown in section in FIG. 5, the cutter element 20 will be formed to define a tangential retainer insertion passage 92 that is oriented in substantially tangential relationship with the registry grooves 60 and 90. An elongated retainer element 94 may be inserted through the passage 92 into the annular retainer chamber defined cooperatively by grooves 60 and 90. The retainer element 94 is flexible and capable of following the annular retainer chamber as it is forced through the passage 92. The retainer element 94 may be composed of a flexible metal material or, in the alternative, it may be formed of any other suitable metallic or non-metallic material without departing from the spirit and scope of the present invention. After insertion of the retainer element the passage 92 may be closed, such as by hardenable plastic material.

As a further alternative, bearing segments may be employed such as shown at 88 in FIG. 5 and a retainer ring element such as the retainer ring shown at 64 in FIG. 2 may be placed in assembly within the annular groove portion 90. After this has been done, the cooled bearing and spindle assembly may then be further assembled to a heated cutter element in the manner discussed above in connection with FIGS. 2 and 3.

Figure 6:
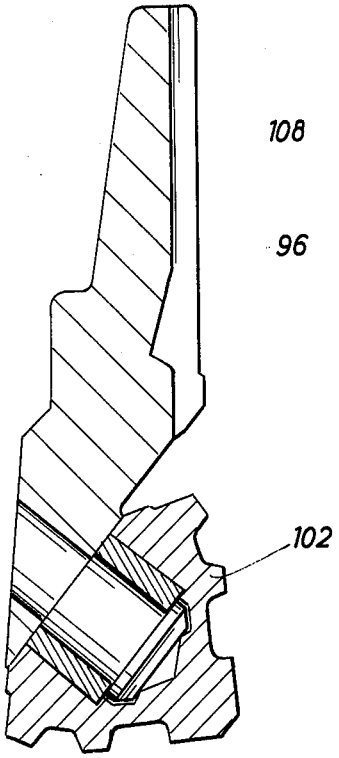
FIGS. 6, 7 and 8 each depict one of the three body segments of a drill body each having one of the three rotary cutting elements rotatably secured thereto in accordance with the teachings of the present invention.
Figure 7:
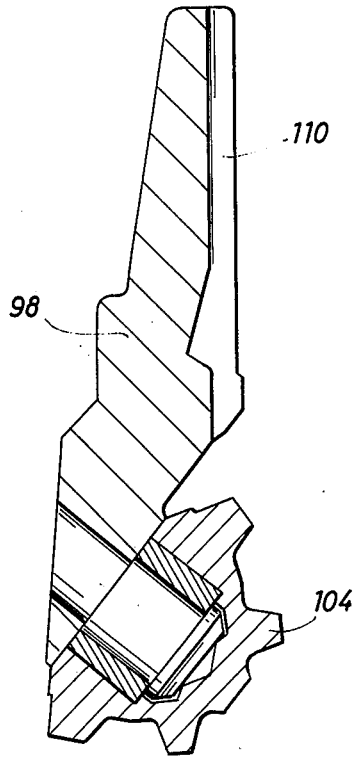
Figure 8:
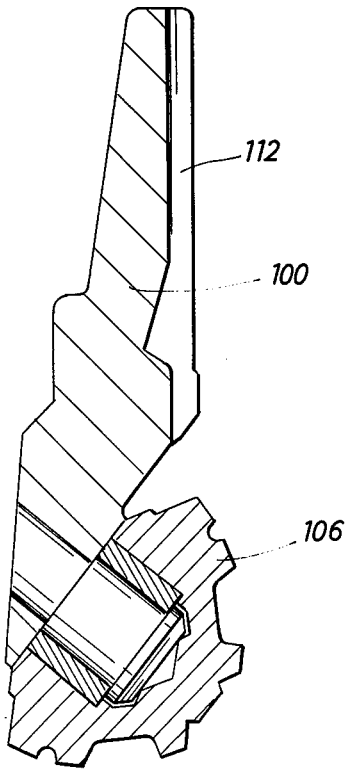

It is also considered desirable to provide a drill body structure that is of low cost nature without any sacrifice from the standpoint of strength and durability. This feature may be conveniently accomplished in the manner illustrated in FIGS. 6 through 8 which show a plurality of body segments that may be connected in assembly by welding to form the body structure of a rotary cutter type drill bit. FIGS. 6–8 each show drill segments 96, 98 and 100 that are of substantially identical configuration. In fact, each of the drill body segments shown in FIGS. 6, 7 and 8 may be identical and may be formed by casting or forging as desired. Since the casting or forging design of each of the body segments is of simple configuration, the casting or forging costs will be quite low and yet the body structure that is developed will be of substantial strength and durability when the body sections are assembled. As further shown in FIGS. 6–8, each of the body sections may be provided with cutter elements 102, 104, and 106 that are of cooperating configuration, allowing the development of a rock bit structure having optimum boring capability upon welded assembly of the body segments 96, 98 and 100. The cutter elements may be rotatably connected to the body structure or to the body segments as the case may be in the same manner discussed above in connection with FIGS. 2–5. Further, if desired, the cutter elements may be assembled to the body segment structures prior to welded connection of the body segments, thus simplifying the assembly procedure of the cutter elements and further enhancing the low cost nature of the drill bit structure. The upper threaded extremity of the drill bit body may be formed by machining after the body segments have been joined.

As shown in FIGS. 6–9, each of the body segments may be provided with internal passage surfaces 108, 110 and 112 respectively that cooperate to define a flow passage 114 when the segments are welded in assembly. Each of these body segments may further be formed to define segment abutment surfaces that are oriented at an angular relationship of 120°. When the body segments are assembled, the abutment surfaces will be in engagement, thus orienting the rotary cutter elements in proper relationship for optimum cutting capability. Each of the body segments may also be formed to cooperatively define weld grooves such as shown at 116, 118 and 120 so that simple linear welds 122, 124 and 126 may be formed to retain the body segments in assembly to define an integral drill body.

Figure 10:
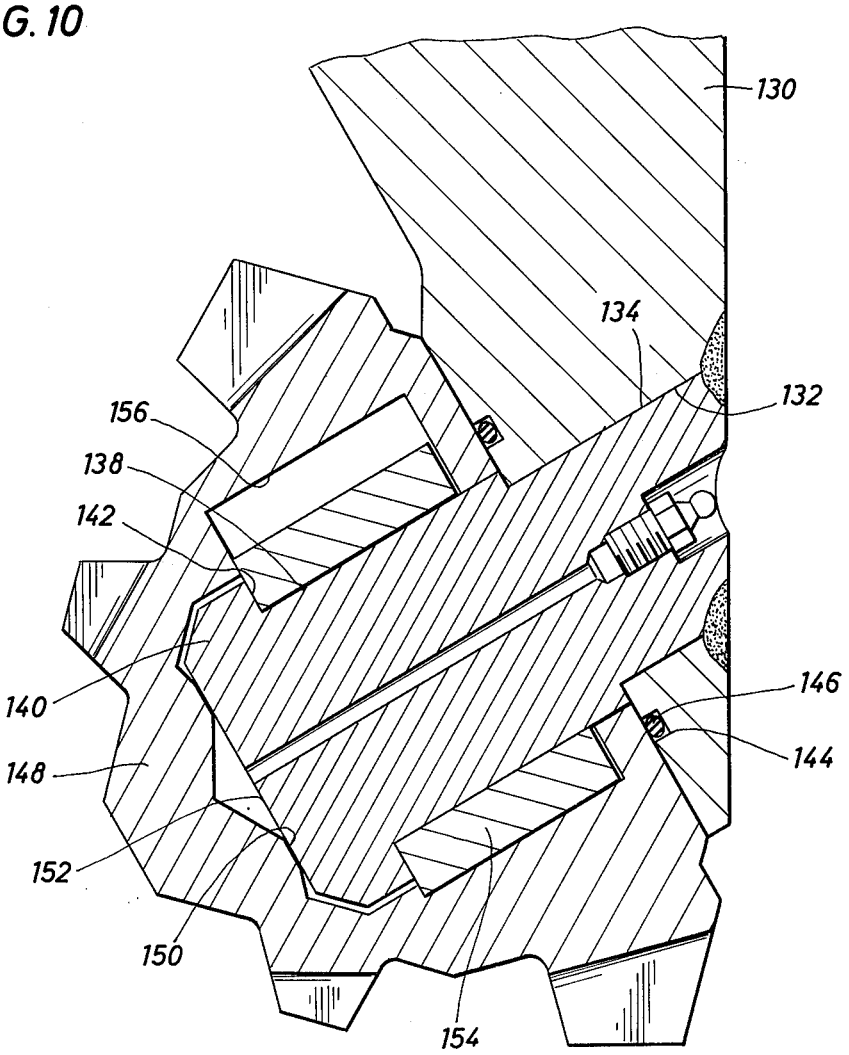
FIG. 10 is a partial sectional view of a drill body and cutter representing a alternative embodiment utilizing segmented bearings.

Referring now to FIG. 10 there is shown an alternative embodiment of this invention wherein segmented bearings are employed. Each of the legs 130 of the body of the bit will be constructed essentially as shown in FIGS. 4 and 6–9 with a bore 132 being formed to receive the connecting portion 134 of the spindle 136. The spindle will be formed to define an enlarged diameter bearing engaging surface 138 and a head portion 140 that defines an annular stop shoulder 142. The seal groove 144 in this case will be of slightly larger diameter as compared to seal groove 76 of FIG. 4 and the sealing element 146 will be of correspondingly larger dimension.

The cutter element 148 will be formed internally in such manner as to receive the spindle with circular bearing surface 150 engaging the planar end surface 152 of the spindle. The cutter element is also formed internally to receive bearing segments 154 that may be of semi-circular configuration or, in the alternative, may be of other partially circular configuration. The cutter element also defines an internal cavity 156 that is formed to allow insertion of the bearing segments after the spindle and cutter have been brought into assembly. This feature allows the cutter, bearing segments and spindle to be secured in interlocked assembly without requiring a retainer ring such as shown at 90 in FIG. 4.

To assemble the cutter element to the spindle, the spindle and cutter will be placed in angulated relation with the spindle within the cutter and with one bearing segment positioned within the bearing insertion chamber of the cutter. Another of the bearing segments will then be inserted into its proper position relative to the cutter. upon movement of the cutter element and spindle to the coaxial relationship thereof the bearing segment retained within the bearing insertion chamber will be shifted to its proper bearing relationship with the spindle. The bearing segments will then be encapsulated and the cutter element will be rotatably secured to the spindle.

In view of the foregoing it is clearly apparent that the present invention provides a rotary drill bit construction having a body structure of exceptional strength and durability and yet being of low cost. The drill body segments, being low cost forged or cast metal structures, may be connected in assembly by simple and efficient low cost welding procedures to define an integral body structure of exceptional strength and durability. The invention also provides for optimum utilization of materials for the various components of the drill bit construction to insure optimum drilling capability and exceptional service life. Lost cost, high strength materials may be utilized for the spindle and bearing structures and the cutter elements may be formed of optimum materials for insuring extended service life. Further, the spindle may be secured by simple welding procedures to the drill body legs or segments thereby further simplifying the construction of the drill bit. Also, the rotary cutter devices may be assembled to body segments prior to formation of the integral body to further simplify the assembly procedure and pipe threads may be machined after the body structure has been assembled. The present invention also promotes utilization of lubrication systems that allow the drill bit structure to be periodically lubricated to further enhance the service life of the bit structure. It is apparent therefore, that the present invention is one well adapted to attain all of the objects and features hereinabove set forth, together with other advantages which will become obvious and inherent from the description of the apparatus itself. It will be understood that certain combinations and subcombinations are of utility and may be employed without reference to other features and subcombinations. As many possible embodiments may be made of this invention without departing from the spirit or scope thereof, it is to be understood that all matters herein set forth or shown in the accompanying drawings are to be interpreted as illustrative and not in a limiting sense.

What is claimed is:

1. A method of manufacturing a rotary earth boring drill including assembling a drill cutter, spindle and bearing to establish a nonrotatable retained relation between said bearing and cutter, said method comprising:

providing a spindle defining a bearing surface having inner and outer extremities;

providing a bearing sleeve having a tapered cutter engaging surface formed on said bearing sleeve causing one extremity of said bearing sleeve to be larger than the other extremity thereof and placing said bearing sleeve in rotatable assembly about said bearing surface of said spindle with said other extremity thereof directed toward said inner extremity of said spindle;

providing a rotary drill cutter having a cavity formed therein to receive said bearing sleeve, the deepest portion of said cavity defining the inner extremity of said cavity and the mouth of said cavity defining the outer extremity of said cavity, said cavity being defined at least in part by an internally tapered bearing engaging surface causing the inner extremity of said bearing engaging surface of said cavity to be of larger dimension than the outer extremity thereof;

cooling said bearing sleeve and spindle to reduce the outside dimension of said bearing sleeve;

heating said drill cutter to increase the inside dimension of said cavity;

inserting said assembled and cooled bearing sleeve and spindle into said cavity of said heated drill cutter; and allowing said drill cutter, said bearing sleeve and said spindle to return to normal temperature and dimension to cause a tight retention fit to develop between said bearing sleeve and said drill cutter, whereby a structural interlocking relation is developed between said drill cutter and said bearing sleeve when said one extremity of said bearing sleeve is received at the inner extremity of said bearing engaging surface of said cutter.

2. A method of manufacturing a rotary earth boring drill as recited in claim 1, wherein said method includes:

forming an internal locking groove within said cutter;

forming an external locking groove externally of said bearing, said internal and external locking groove registering upon assembly of said bearing within said cutter to define a locking chamber; and inserting a locking retainer element into said chamber during assembly of said cutter element and bearing.

3. A method of manufacturing a rotary earth boring drill as recited in claim 1 wherein said method includes:

forming an internal locking groove within said cutter and forming an external locking groove externally of said bearing, said internal and external locking grooves registering upon assembly of said bearing within said cutter to define a locking chamber; and inserting a locking retainer element into said chamber following assembly of said cutter element and bearing.

4. A method of manufacturing a rotary earth boring drill as recited in claim 1, wherein said spindle defines bearing shoulders at each extremity of said bearing surface, and said method includes:

placing bearing segments about said bearing surface prior to inserting said spindle and said bearing into said cavity.

5. A method of manufacturing a rotary earth boring drill as recited in claim 4, wherein said method includes:
forming an external locking groove in said bearing segments; and
locating a bearing retainer element within said locking groove of said bearing segments to retain said bearing segments in assembly with said bearing surface of said spindle prior to assembly of said spindle and said bearing within said cavity.

6. A method of manufacturing a rotary earth boring drill as recited in claim 1, wherein said method includes:
providing a drill body having a plurality of depending cutter support legs;
forming a spindle bore in each of said cutter support legs;
inserting each of said spindles at least partially into the respective ones of said bores; and
attaching said spindles to said depending cutter support legs by welding.

7. A method of manufacturing a rotary earth boring drill as recited in claim 1, wherein said method includes:
providing a plurality of body segments;
forming spindle connection means in each of said body segments;
placing said body segments in intimate assembly;
securing said body segments in assembly to define a drill body; and
securing a plurality of spindle, cutter and bearing assemblies to said drill body.

8. A method of manufacturing a rotary earth boring drill as recited in claim 1, wherein said method includes:
providing a plurality of body segments;
forming spindle connection means in each of said body segments;
securing a spindle, bearing and cutter assembly to each of said body segments;
placing said body segments in intimate assembly; and
securing said body segments in assembly.

9. A rotary earth boring drill for connection to the drill pipe of drilling apparatus, said drill comprising:
drill body means defining a plurality of depending cutter support legs;
a spindle element extending from each of said cutter support legs and defining a generally cylindrical bearing surface;
a bearing element being disposed in rotatable relation with said spindle element, said bearing element having inner and outer extremities;
a cutter element having a cavity formed therein, the deepest part of said cavity defining the inner extremity of said cavity and the mouth of said cavity defining the outer extremity of said cavity, said cavity receiving said bearing element in nonrotatable relation therein;
means establishing a mechanically interlocked relation between said cutter element and said bearing comprising:
a tapered cutter engaging surface formed on said bearing causing the outer extremity of said bearing to be larger than the inner extremity thereof; and
an internally tapered bearing engaging surface being formed within said cutter and defining at least a part of said cavity and causing the bearing engaging surface at the inner extremity of said cavity to be of larger dimension than the outer extremity thereof, said outer extremity of said bearing being received at the inner extremity of said bearing engaging surface of said cutter.

10. A rotary earth boring drill as recited in claim 9, wherein:
each of said depending legs of said drill body is formed to define a spindle connection aperture;
each of said spindles is formed with a connection portion receivable within said spindle connection aperture; and
connection between said spindles and the respective one of said depending legs of said drill body is established by welding.

11. A rotary earth boring drill as recited in claim 9, wherein:
said drill body is formed by a plurality of body segments, said body segments being secured in assembly by welding.

12. A rotary earth boring drill as recited in claim 11, wherein:
said body segments cooperate to define flow passage means for directing flowing drilling fluid from the drill pipe toward said rotary cutters.

13. A rotary earth boring drill as recited in claim 11. wherein:
each of said body segments defines a portion of said drill body and one of said depending legs.

14. A rotary earth boring drill as recited in claim 9, wherein:
said drill body is formed by a plurality of body segments; and
said spindle, bearing and cutter elements are assembled to said body segments prior to securing said body segments in assembly.

15. A rotary earth boring drill as recited in claim 9, wherein said spindle element comprises:
an elongated cutter support having an enlarged head formed at one extremity thereof and defining an annular shoulder;
a generally cylindrical bearing surface formed intermediate the extremities of said elongated cutter support; and
a spindle connector portion being formed at the other extremity of said elongated cutter support, said connector portion being receivable in connection with one of said depending legs of said body.

16. A rotary earth boring drill as recited in claim 9, wherein:
a generally planar bearing face is formed on each of said depending legs of said drill body and oriented in substantially normal relation with the axis of said spindle;
shoulder means defined on said spindle being in engagement with said bearing face and positioning said spindle relative to said depending leg portion; and
said bearing and cutter element having rotatable engagement with said bearing face.

17. A rotary earth boring drill as recited in claim 9, wherein:
lubrication means is defined within said spindle and provides for lubrication of said bearing and spindle.

18. A rotary earth boring drill as recited in claim 9, wherein said spindle comprises:
an elongated cutter support having a generally cylindrical bearing surface formed intermediate the extremities thereof;

annular shoulder means being located at each extremity of said bearing surface;

a spindle connector portion being formed at one extremity of said elongated cutter support and being receivable in connection with one of said depending legs of said body; and said bearing means being a plurality of bearing segments that are receivable about said bearing surface.

19. A rotary earth boring drill as recited in claim 18, wherein:

said bearing means defines retainer groove means;

said cutter means defines internal retainer groove means cooperating with said retainer groove means of said bearing means to define retainer chamber means; and retainer means being positionable with said retainer chamber means to lock said cutter and said bearing in assembly.

20. A rotary earth boring drill as recited in claim 9, wherein:

said bearing element is defined by bearing segment means; and said cutter element is formed internally to receive said segment means and allow said segment means to establish interlocking retaining relation with said cutter element and spindle.

21. A rotary earth boring drill for connection to the drill pipe of drilling apparatus, said drill comprising:

drill body means defining a plurality of depending cutter support legs;

a spindle element extending from each of said cutter support legs and defining a generally cylindrical bearing surface;

a bearing element being disposed in rotatable relation with said spindle element and defining inner and outer extremities;

a cutter element having a cavity formed therein, the deepest part of said cavity defining the inner extremity thereof and the mouth of said cavity defining the outer extremity thereof, said cavity receiving said bearing element in nonrotatable relation therein;

means establishing a mechanically interlocked relation between said cutter element and said bearing comprising:

a tapered cutter engaging surface being formed on said bearing causing said outer extremity of said bearing to be of larger dimension than the inner extremity thereof;

an internally tapered surface being formed within said cutter and defining at least a part of said cavity, said internally tapered surface being of larger dimension at the inner extremity thereof than at the outer extremity thereof and being of mating taper with said tapered surface of said bearing; and said cutter and said bearing being capable of assembly only upon the establishment of a predetermined temperature differential therebetween and upon reaching a predetermined normal temperature said mechanically interlocked condition is developed.

22. A rotary earth boring drill for connection to the drill pipe of drilling apparatus, said drill comprising:

drill body means defining a plurality of depending cutter support legs;

a spindle element extending from each of said cutter support legs and defining a generally cylindrical bearing surface;

a bearing element being disposed in rotatable relation with said spindle element;

a cutter element having a cavity formed therein, said cavity receiving said bearing element in shrink fitted nonrotatable relation therein;

means establishing a mechanically interlocked relation between said cutter element and said bearing comprising:

an external retainer groove being formed in said bearing;

an internal retainer groove being formed in said cutter and being registered with said external retainer groove of said bearing when in assembly to define a retainer chamber; and a single split-ring type retainer element being positioned within said retainer chamber and providing a single split-ring type retainer element being positioned within said retainer chamber and providing shear resistance to prevent separation of said cutter from said bearing in the event said nonrotatable relation between said cutter and bearing should fail.

23. A method of manufacturing a rotary earth boring drill including assembling a drill cutter, spindle and bearing to establish a nonrotatable retained relation between said bearing and cutter, said method comprising:

providing a spindle defining a bearing surface, said spindle having an inner extremity for connection to a drill body and an outer extremity;

providing a bearing sleeve having a tapered external cutter engaging surface formed thereon defining an outer extremity of said bearing of larger dimension than the inner extremity thereof and placing said bearing sleeve in rotatable assembly about said bearing surface of said spindle with said inner extremity of said bearing sleeve located at the inner extremity of said spindle;

providing a rotary drill cutter having a cavity formed therein to receive said bearing sleeve and having an internally tapered surface being formed within said cutter defining at least a part of said cavity, said internally tapered surface being of mating taper with said tapered external surface of said bearing and said cutter and said bearing being capable of assembly only upon the establishment of a predetermined temperature differential therebetween;

cooling said bearing sleeve and spindle to reduce the outside dimension of said bearing sleeve;

heating said drill cutter to increase the inside dimension of said cavity;

inserting said assembled and cooled bearing sleeve and spindle into said cavity of said heated drill cutter; and allowing said drill cutter, said bearing sleeve and said spindle to return to a predetermined normal temperature and dimension to cause a tight retention fit to develop between said bearing sleeve and said drill cutter and a mechanically interlocked condition therebetween.

24. A method of manufacturing a rotary earth boring drill including assembling a drill cutter, spindle and bearing to establish a nonrotatable retained relation between said bearing and cutter, said method comprising:

providing a spindle defining a bearing surface;

providing a bearing sleeve and placing said bearing sleeve in rotatable assembly about said bearing surface of said spindle;

providing a rotary drill cutter having a cavity formed therein to receive said bearing sleeve;

forming an internal locking groove within said cutter;

forming an external locking groove externally of said bearing, said internal and external locking groove registering upon assembly of said bearing within said cutter to define a locking chamber; and inserting a split-ring type locking retainer element into said chamber during assembly of said cutter element and bearing to provide secondary retention preventing separation of said cutter from said bearing in the event said nonrotatable relation between said cutter and bearing should fail;

cooling said bearing sleeve and spindle to reduce the outside dimension of said bearing sleeve;

heating said drill cutter to increase the inside dimension of said cavity;

inserting said assembled and cooled bearing sleeve and spindle into said cavity of said heated drill cutter; and allowing said drill cutter, said bearing sleeve and said spindle to return to normal temperature and dimension to cause a nonrotatable tight primary retention fit to develop between said bearing sleeve and said drill cutter, thus developing a mechanically interlocked relation between said cutter element and said bearing.

* * * * *